US006626297B2

(12) United States Patent
Dailey

(10) Patent No.: US 6,626,297 B2
(45) Date of Patent: Sep. 30, 2003

(54) MAGNETIC SEPARATOR DEVICE FOR DISPOSAL UNIT

(75) Inventor: Mark E. Dailey, Melrose, MA (US)

(73) Assignee: Shiloh Partners, LLC, Melrose, MA (US)

( * ) Notice: Subject to any disclaimer, the term of this patent is extended or adjusted under 35 U.S.C. 154(b) by 0 days.

(21) Appl. No.: 09/731,676

(22) Filed: Dec. 6, 2000

(65) Prior Publication Data

US 2002/0066696 A1 Jun. 6, 2002

Related U.S. Application Data

(60) Provisional application No. 60/169,827, filed on Dec. 8, 1999.

(51) Int. Cl.[7] ..... B03C 1/00

(52) U.S. Cl. ..... 209/223.1; 209/214; 209/636; 209/926

(58) Field of Search ..... 209/213, 214, 209/223.1, 926, 215, 636; 241/46.013

(56) References Cited

U.S. PATENT DOCUMENTS

| | | | | |
|---|---|---|---|---|
| 4,034,422 A | * | 7/1977 | Farber et al. | 241/36 X |
| 4,279,744 A | | 7/1981 | Antonwitsch | 209/214 |
| 4,367,138 A | | 1/1983 | Kustas | 209/224 |
| 4,706,818 A | | 11/1987 | Zutell et al. | 209/636 |
| 4,782,970 A | | 11/1988 | Edwards | 220/1 |
| 4,875,785 A | * | 10/1989 | Santos et al. | 384/448 |
| 5,624,503 A | | 4/1997 | Yamashita | 148/103 |

FOREIGN PATENT DOCUMENTS

| | | | | |
|---|---|---|---|---|
| GB | 2170737 | * | 8/1986 | 209/926 |
| JP | 02095457 A | | 4/1990 | |

* cited by examiner

*Primary Examiner*—Tuan N. Nguyen
(74) *Attorney, Agent, or Firm*—Hamilton, Brook, Smith & Reynolds, P.C.

(57) ABSTRACT

A garbage disposal protection device prevents the entry of ferro-magnetic objects into the disposal unit while maintaining an unobstructed path for items intended for the disposal to freely pass through the entry of the disposal. The device is an annular magnetic ring which fits into the drain at the bottom of a standard household sink and captures the ferro-magnetic objects before they enter the disposal unit. An alternative embodiment utilizes a magnetic ring that is made up of multiple magnetic elements contained in a retaining member.

26 Claims, 4 Drawing Sheets z* Partition walls >0.175 thick x 8 walls Equally Spaced

MAGNETIC SEPARATOR DEVICE FOR DISPOSAL UNIT

RELATED APPLICATION(S)

This application claims benefit to U.S. Provisional Application No. 60/169,827, filed Dec. 8, 1999, entitled "Magnetic Separator Device for Disposal Unit," by Mark E. Dailey, the entire teachings of which are incorporated herein by reference.

BACKGROUND OF THE INVENTION

Common household garbage disposals such as the In-Sink-Erator brand are attached to the bottom of the sink around the drain. Because the entry to such a garbage disposal is then at or below the drain of the sink, it is often the case that knives, forks, spoons and other common kitchen utensils enter the disposal. This is a hazard not only to a person standing at the sink, but also to both the disposal device itself and the items that are inadvertently dropped into it. If the disposal device is turned on while such objects are inside it will likely mangle those items and probably damage the disposal as well and could even cause an object to be ejected with force. Thus, it would be very beneficial to have a means for preventing these foreign objects that are not intended to go into the disposal from ever going down the drain and is, accordingly an object of this invention.

There have been several attempts disclosed in the prior art to solve this problem, many of which use magnetism as a means for preventing objects from falling into the disposal. U.S. Pat. No. 4,706,818 to Zutell, titled "Magnetic Flatware Retriever," describes such a device. The magnetic flatware retriever described in the '818 patent clearly demonstrates one of the major shortcomings of the prior art. Magnetic elements that are meant to trap flatware and keep them from falling into the disposal, are positioned in or near the middle of the drain, thereby obstructing the entry to the disposal to any objects including those such as food scraps which are intended to go into the disposal. Such obstructions in the drain and entry to the disposal limit the size of food scraps and other objects that are intended for the disposal from entering the disposal.

SUMMARY OF THE INVENTION

The present invention solves the shortcomings of the prior art by providing a means for preventing the entry of unwanted objects into the garbage disposal while at the same time maintaining a clear and unobstructed pathway for food scraps and other items intended for the disposal. The device comprises magnetic means that will attract ferro-magnetic objects, the magnetic means being strong enough to engage and hold the ferro-magnetic objects and thereby prevent them from entering the disposal. "Ferromagnetic objects" are objects made of metals which are normally attracted to magnets.

This protection device is shaped and positioned so that an unrestricted passageway is created in the center of the drain allowing the passage of non-ferromagnetic objects into the disposal. The basic shape of the device is a continuous annular ring. The ring is thin measuring approximately 0.125 inches (to about 0.25 inches) between the inner and outer diameters. When installed in the drain portion of the sink (i.e., about the periphery of the drain opening), the protection device reduces the inner diameter of the drain only by less than 0.5 inches. Despite its thin size, the magnet creates a magnetic field of approximately 10–20 magnetic Gauss, the magnetic fields radially crossing to create the strongest portion of the magnetic field in the center of the drain. The magnet is made from an anisotropic magnetic powder that is magnetically aligned and heated to form its proper shape. The magnet is then covered or coated with a polypropylene, epoxy resin, fiberglass, or plastic coating or covering. This covering may be colored red in the preferred embodiment of the invention.

Alternatively, the device may be made of more than one magnetic element. For example, a retaining member may contain two or more magnetic elements that are arranged to form a magnetic ring.

Also disclosed is a method for preventing ferro-magnetic objects from entering a disposal which comprises the steps of providing the protection device described above and positioning it at the periphery of the opening to the disposal.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

A description of preferred embodiments of the invention follows.

Figure 1:
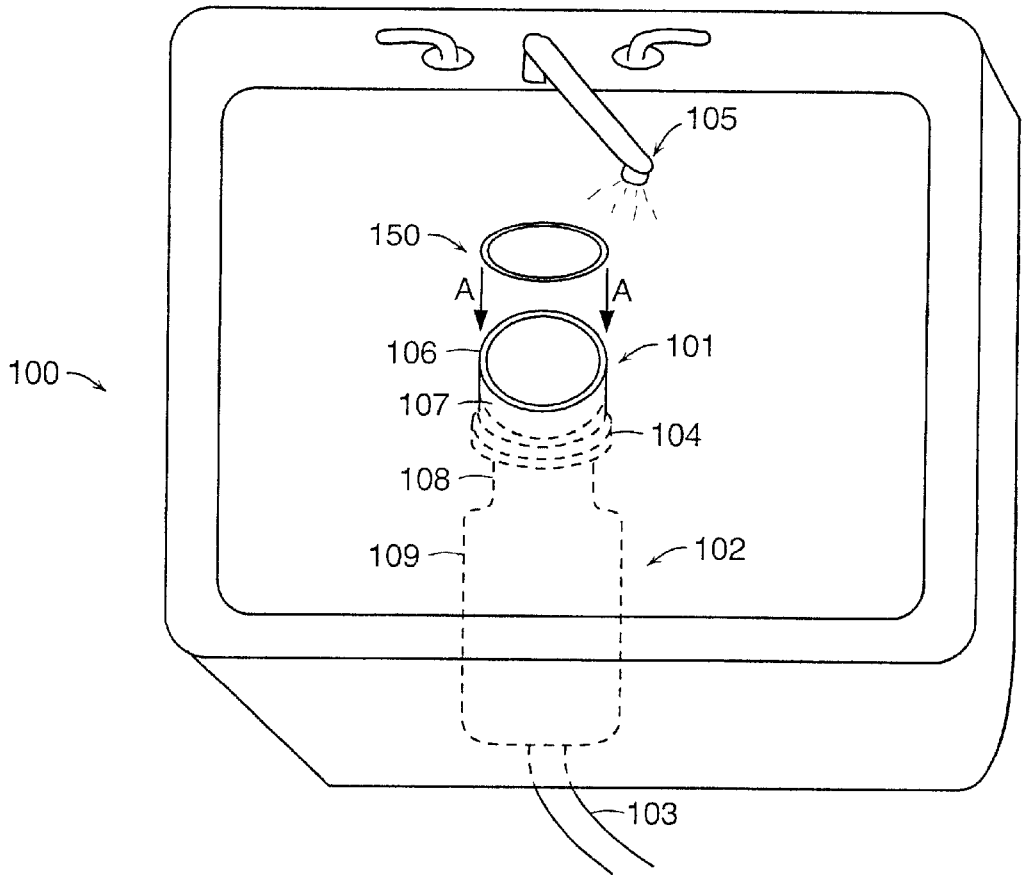
FIG. 1 is a perspective view of a typical sink with a garbage disposal and a disposal protection device of the present invention aligned with the drain prior to installation.
Figure 2:
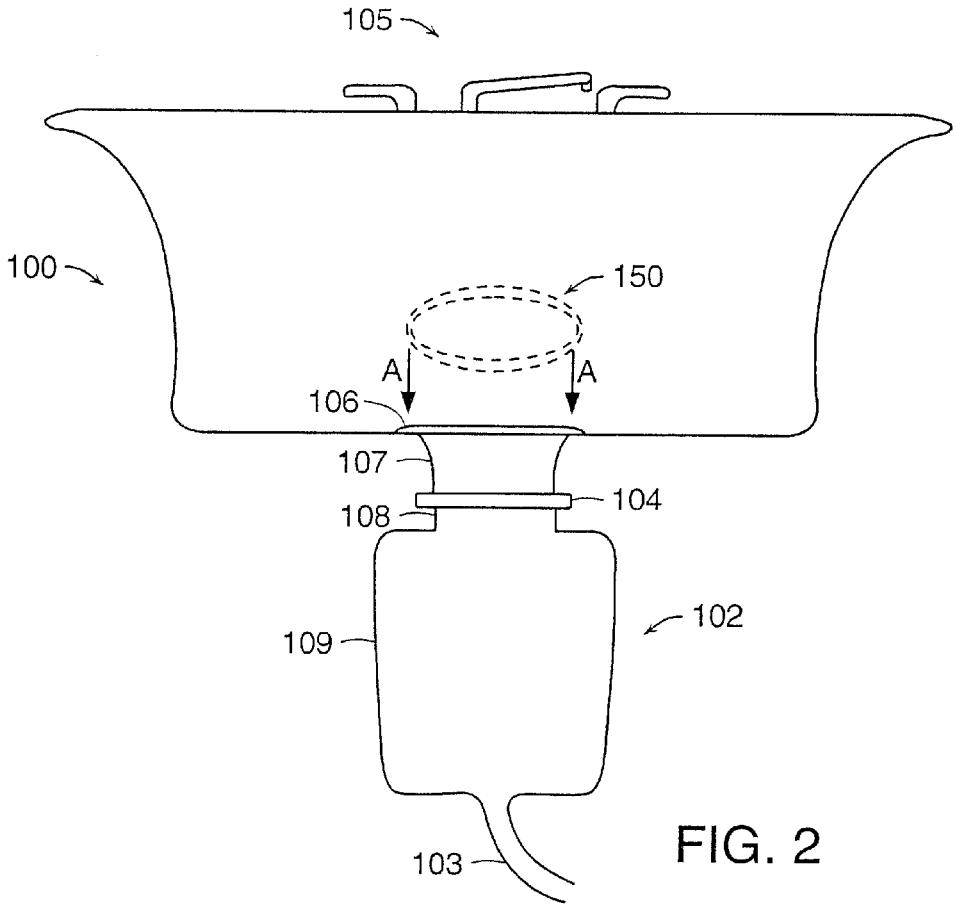
FIG. 2 is a side elevation of a typical kitchen sink with a garbage disposal unit and the disposal protection device aligned with the drain prior to installation.

FIG. 1 and FIG. 2 show a perspective and profile view, respectively, of a typical kitchen sink and a garbage disposal assembly. At the bottom of the typical sink 100 is a drain 101. The drain 101 is generally cylindrical with a body portion 107 and a flange portion 106 located on top of the body portion 107. The flange 106 rests on the bottom of the inside of the sink 100 keeping the drain in the appropriate position. The garbage disposal unit 102 generally consists of the main disposal section 109, a neck 108 which is attached to the bottom of the drain 101 and a waste return portion 103 which connects to the plumbing return system. The main portion of the disposal 109 contains the area in which waste food is ground up for passage into the waste return portion 103. Typically, there is a collar 104 that helps attach the neck 108 of the disposal to the body portion 107 of the drain. The faucet fixture 105 attaches to the top flange area of the sink 100.

Figure 3:
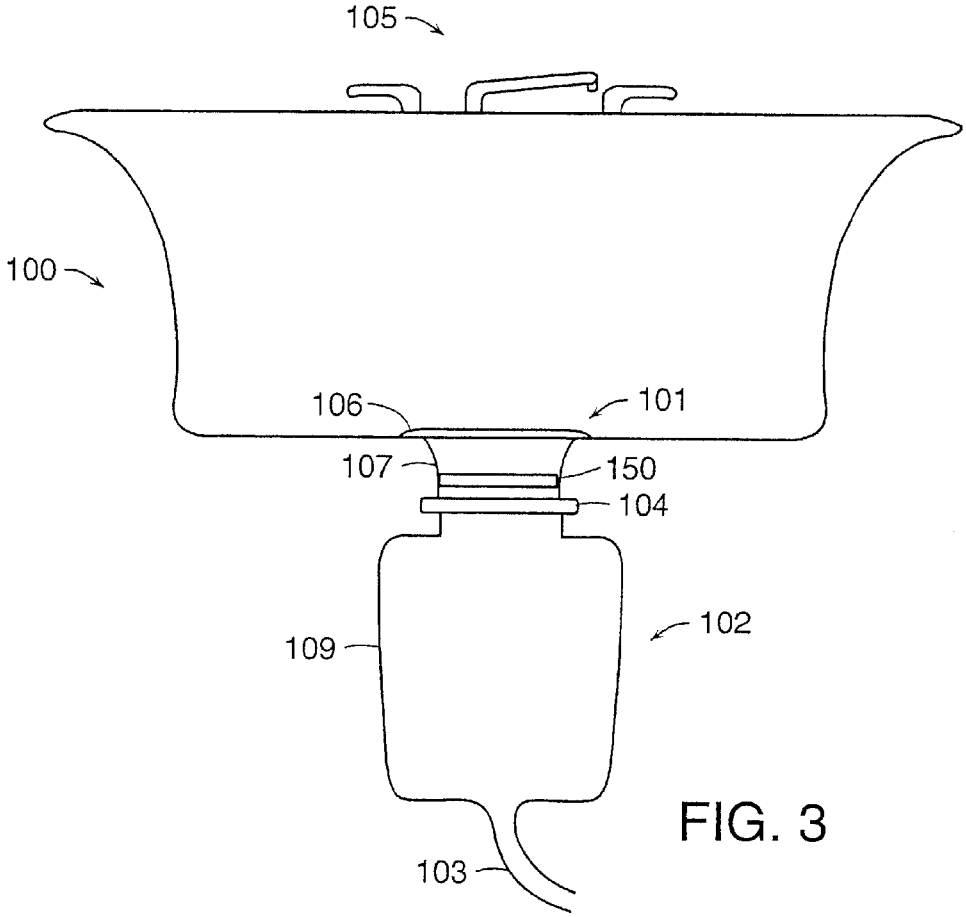
FIG. 3 is a side elevation of a typical kitchen sink and garbage disposal unit with the disposal protection device installed at the entry to the disposal.

The present invention is intended to be easily installed by a homeowner. No disassembly of the garbage disposal unit 102, sink 100 or drain 101 should be required. The disposal protection device 150 of the present invention is lowered in the direction of arrow A into the drain 101. In FIG. 3, the disposal protection device 150 can be seen in its installed position in the cylindrical body portion 107 of the drain. The disposal protection device 150 is sized and shaped so that it fits snugly around the perimeter of the inside wall of the standard size household drain 101. Thus, for installation the homeowner simply pushes the disposal protection device 150 as far down into the cylindrical body portion 107 of the drain 101 until it fits tightly. Once installed in this position, the disposal protection device 150 will attract and hold ferro-magnetic objects that fall into the drain portion 101 of the sink 100, thereby preventing them from falling into the garbage disposal unit 102 per se. The foreign objects are thus made easily retrievable by the homeowner without having to reach down into the main disposal container 109.

Figure 4:
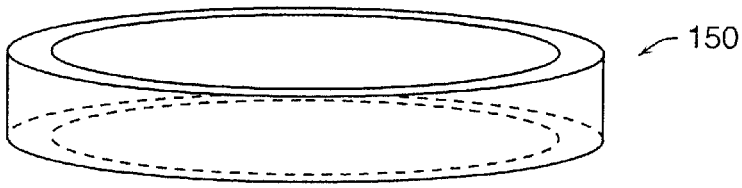
FIG. 4 is a perspective view of the disposal protection device.
Figure 6A:
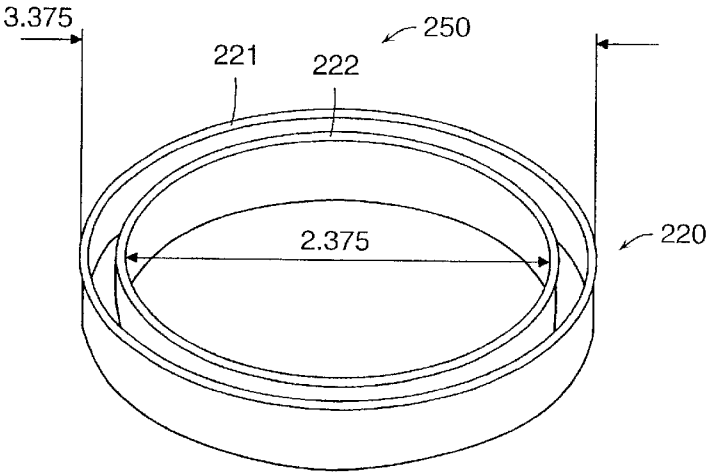
FIG. 6A is a schematic drawing of the corresponding top portion of the retaining member for the alternative embodiment of the invention.
Figure 6B:
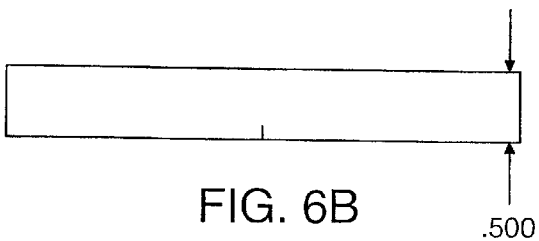
FIG. 6B is a side elevation of the top portion of the retaining member for the alternative embodiment of the invention.

The preferred embodiment of the invention consists of a single piece magnetic annular ring. FIG. 4 shows a three dimensional view of this magnetic ring and its preferred dimensions. The height is approximately 0.5 inches (1.27 cm). The inner diameter is approximately 2.875 inches (7.3025 cm) and the outer diameter approximately 3.375 inches (8.5725 cm). The difference between the outer diameter and the inner diameter therefore is approximately 0.5 inches. Thus when installed, the disposal protection device 150 only decreases the inner diameter of the drain 101 by 0.5 inches (1.27 cm). This small decrease in the inner diameter of the drain 101 allows the disposal protection device 150 to provide a relatively unencumbered pathway for objects intended for the garbage disposal to pass easily through the disposal protection device 150 into the main disposal container 109.

A single piece annular magnetic ring may be made from anisotropic magnetic powders. Such a method is described in U.S. Pat. No. 5,624,503 to Yamashita ("Process for Producing Nd—Fe—B Magnet"). Once made, the magnet may be coated with a polypropylene coating. Other materials that may be used for the magnet's coating include polypropylene, epoxy resin, fiberglass, vinyls, plastics or PVCs.

The magnet must be of sufficient magnetic strength to attract typical ferromagnetic objects that might fall into the disposal 109. Such objects include knives, forks, spoons, other flatware or kitchen utensils. In the preferred embodiment, a magnet with a magnetic field strength of 10–20 Gauss (100,000–200,000 Tesla) is used.

Figure 5A:
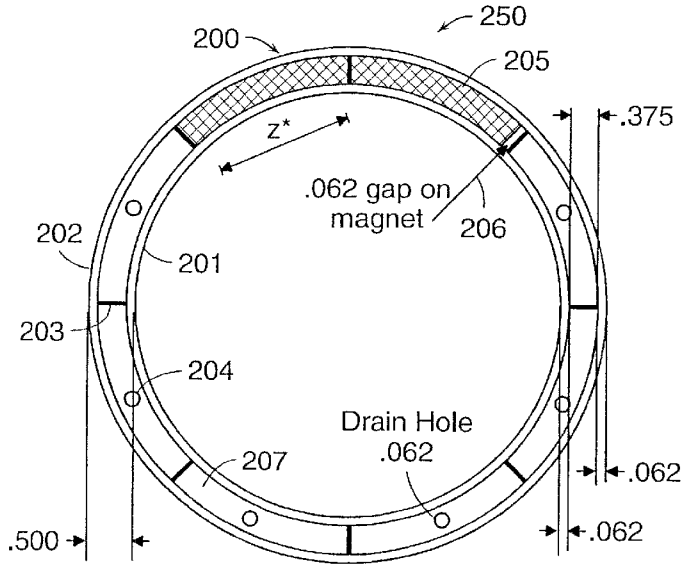
FIG. 5A is a schematic drawing of the bottom portion of a retaining member used in the alternative embodiment of the invention.
Figure 5B:
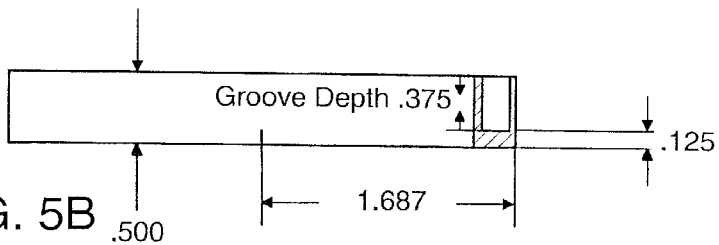
FIG. 5B is a side elevation of the bottom portion of a retaining member used in the alternative embodiment of the invention partially in section.

FIGS. 5A, 5B, 6A and 6B show parts of an alternative embodiment of the invention. Such an alternative embodiment forms an annular magnetic ring from several magnetic elements 205. The magnetic elements 205 are enclosed in a retaining member 250. FIGS. 5A and 5B illustrate the bottom 200 and top 220 portions of that retaining member 250, respectively. Referring to the bottom portion 200 of the retaining member 250, the bottom portion 200 is sectioned into eight container sections 207 that are divided by walls 203. While the alternative embodiment shown contains eight magnetic elements 205, similar results can be accomplished with any multiple number of magnetic elements 205.

At the bottom of each container section 207 is a drain hole 204. Magnet elements 205 are inserted into each of the eight container sections 207. The magnet elements 205 are shaped such that they fit snugly between the inner wall 201 and the outer wall 202 of the bottom portion 200 of the retaining member. However, a small gap 206 is left between the magnet element 205 and the divider portions 203 of the retaining member. Once all eight of the magnet elements 205 are inserted into the respective container sections 207 (e.g., snap together style) of the bottom portion 200 of the retaining member, the top portion 220 of the retaining member is then inserted on top of the bottom portion 200. Once assembled, the disposal protection device 150 is then ready for insertion into the drain portion 101 of the sink. Preferably, the disposal protection device 150 would come assembled in its package.

Optimal thickness of the inner wall 201 and outer wall 202 of the bottom portion 200 of the retaining member, as well as the inner and outer walls 222, 221 of the top portion 220 of the retaining member, is 0.062 inches (0.15748 cm). The width of the container sections 207 measures 0.375 inches (0.9525 cm). The depth of the container sections is 0.375 inches (0.9525 cm). The height of inner and outer walls 201, 202 of bottom portion 200 as well as that of top portion 220 is 0.500 inch (1.27 cm). Thus, total height of the combined bottom 200 and top 220 portions of the retaining member is 0.5 inches (1.27 cm) where the top portion 220 fits over the bottom portion 200. The inner diameter of the top portion 220 is 2.375 inches (6.0325 cm) and the outer diameter is 3.375 inches (8.5725 cm). The outer diameter of the bottom portion 200 is about 3.374 inches (8.56996 cm). The inner diameter of bottom portion 200 is about 2.376 inches (6.03504 cm). The tolerances between the outer walls 202 and 221 of bottom and top portions 200, 220 and that between the inner walls 201 and 222 of these portions 200, 220 are sufficiently tight such that the bottom portion 200 inserted into top portion 220 is frictionally held in place.

The retaining member may be formed of plastic, vinyl, PVC using molds, extrusion techniques and the like.

The measurements and shapes given for the disposal protection devices described herein are applicable for the standard size drain commonly found in the sinks in the U.S. households, offices and restaurants, etc. However, the invention can easily be adapted to accommodate sinks and drains of various sizes and shapes. For drains of larger or smaller diameter, the magnetic ring of the preferred embodiment need only be resized accordingly. Should a drain be shaped differently than the common circular drains, i.e., a rectangle or triangle, a suitably shaped magnet that fits within the perimeter of those drains can easily be made by the process described herein. Such varieties of shapes and sizes are contemplated by this disclosure.

While this invention has been particularly shown and described with references to preferred embodiments thereof, it will be understood by those skilled in the art that various changes in form and details may be made therein without departing from the scope of the invention encompassed by the appended claims.

What is claimed is:

1. A protection device for preventing the entry of ferro-magnetic objects into thy opening of a disposal comprising:

magnetic means to engage ferro-magnetic objects;

the magnetic means having sufficient magnetic field strength to attract and hold ferro-magnetic objects to prevent them from entering the disposal, the magnetic field strength being effectively about 10–20 magnetic gauss;

the magnetic means having a single piece continuous annular ring configuration that produces an effective magnetic field of a substantially continuous annular ring;

the single piece continuous annular ring configuration enabling the disposal protection device to be retrofit positioned at the periphery of the opening to create an unrestricted passageway to permit the passage of non-ferro-magnetic objects into the disposal.

2. A protection device according to claim 1 wherein said single piece continuous annular ring configuration has an inner diameter and an outer diameter, the difference between said inner diameter and said outer diameter being about 0.125–0.25 inches.

3. A protection device according to claim 1 wherein said protection device reduces an inner diameter of the opening of said disposal by about 0 to 0.5 inches when installed.

4. A protection device according to claim 1 wherein said magnetic means is made from an anisotropic magnetic powder.

5. A protection device according to claim 1 wherein said magnetic means comprises at least two magnetic elements.

6. A protection device according to claim 1 further comprising a retaining member enclosing said magnetic means.

7. A protection device according to claim 6 wherein said retaining member is made from polypropylene.

8. A protection device according to claim 6 wherein said retaining member is made from epoxy resin.

9. A protection device according to claim 6 wherein said retaining member is made from fiberglass.

10. A protection device according to claim 6 wherein said retaining member is made from vinyl.

11. A protection device according to claim 6 wherein said retaining member is made from plastic.

12. A protection device according to claim 6 wherein said retaining member is colored red.

13. A protection device for preventing the entry of ferro-magnetic objects into the opening of a disposal comprising:

magnetic means to engage ferro-magnetic objects;

the magnetic means being of sufficient magnetic field strength of about 10–20 magnetic gauss, to attract ferro-magnetic objects and prevent them from entering the disposal;

the magnetic means having a single piece continuous annular ring configuration that produces an effective magnetic field of a substantially continuous annular ring;

the single piece continuous annular ring configuration enabling the disposal protection device to be removably positioned at the periphery of the opening and to create an unrestricted passageway to permit the passage of non-ferro-magnetic objects into the disposal.

14. A protection device according to claim 13 wherein the single piece continuous annular ring configuration enables retrofitting of the device into the disposal.

15. A method for preventing ferro-magnetic objects from entering a disposal comprising:

(A) providing a protection device comprising:

magnetic means to engage ferro-magnetic objects;

the magnetic means having sufficient magnetic field strength of about 10–20 magnetic gauss to attract and hold ferro-magnetic objects to prevent them from entering the disposal;

the magnetic means having a single piece continuous annular ring configuration that produces an effective magnetic field of a substantially continuous annular ring;

the single piece continuous annular ring configuration enabling the disposal protection device to be retrofit positioned at the periphery of the opening to create an unrestricted passageway to permit the passage of non-ferro-magnetic objects into the disposal; and (B) positioning the protection device at the periphery of the opening.

16. A method according to claim 15 wherein said annular ring has an inner diameter and an outer diameter, the difference between said inner diameter and said outer diameter being about 0.125–0.25 inches.

17. A method according to claim 15 wherein said protection device reduces an inner diameter of the opening of said disposal by about 0 to 0.5 inches when installed.

18. A method according to claim 15 wherein said magnetic means is made from an anisotropic magnetic powder.

19. A method according to claim 15 wherein said magnetic means comprises at least two magnetic elements.

20. A method according to claim 15 wherein said magnetic means is enclosed within a retaining member.

21. A method according to claim 20 wherein said retaining member is made from polypropylene.

22. A method according to claim 20 wherein said retaining member is made from epoxy resin.

23. A method according to claim 20 wherein said retaining member is made from fiberglass.

24. A method according to claim 20 wherein said retaining member is made from vinyl.

25. A method according to claim 20 wherein said retaining member is made from plastic.

26. A method according to claim 20 wherein said retaining member is colored red.

* * * * *

UNITED STATES PATENT AND TRADEMARK OFFICE

CERTIFICATE OF CORRECTION

PATENT NO. : 6,626,297 B2
DATED : September 30, 2003
INVENTOR(S) : Mark E. Dailey It is certified that error appears in the above-identified patent and that said Letters Patent is hereby corrected as shown below:

Column 4,
Line 64, delete “thy” and insert -- the --.

Signed and Sealed this

Second Day of December, 2003

JAMES E. ROGAN
*Director of the United States Patent and Trademark Office*